United States Patent [19]

Tanaka et al.

[11] Patent Number: 4,617,245

[45] Date of Patent: Oct. 14, 1986

[54] LIGHT RECEIVING MEMBER HAVING TAPERED REFLECTIVE SURFACES BETWEEN SUBSTRATE AND LIGHT RECEIVING LAYER

[75] Inventors: Shigemori Tanaka; Fumio Sumino; Keiji Kubo, all of Tokyo; Masafumi Hisamura; Hitoshi Toma, both of Kawasaki; Naoto Fujimura, Yokohama, all of Japan

[73] Assignee: Canon Kabushiki Kaisha, Tokyo, Japan

[21] Appl. No.: 697,141

[22] Filed: Feb. 1, 1985

[30] Foreign Application Priority Data

Feb. 9, 1984 [JP] Japan ..... 59-22674

[51] Int. Cl.[4] ..... G03G 15/00; G03G 15/04

[52] U.S. Cl. ..... 430/58; 430/56; 430/69; 430/496; 430/524; 430/945

[58] Field of Search ..... 430/58, 496, 524, 945, 430/56, 69

[56] References Cited

U.S. PATENT DOCUMENTS

| | | | |
|---|---|---|---|
| 3,542,556 | 11/1970 | Jones | 430/496 |
| 3,751,258 | 8/1973 | Howe et al. | 430/496 |
| 3,801,315 | 4/1974 | Gundlach et al. | 430/56 X |
| 3,955,976 | 5/1976 | Honjo et al. | 430/69 X |
| 4,076,564 | 2/1978 | Fisher | 430/56 X |
| 4,305,081 | 12/1981 | Spong | 430/945 X |
| 4,318,112 | 3/1982 | Kivits et al. | 430/945 X |
| 4,380,769 | 4/1983 | Thomas et al. | 430/945 X |
| 4,464,450 | 8/1984 | Teuscher | 430/65 X |
| 4,492,967 | 1/1985 | Broer et al. | 430/945 X |
| 4,509,161 | 4/1985 | Van de Leest et al. | 430/945 X |

FOREIGN PATENT DOCUMENTS

| | | |
|---|---|---|
| 39-17748 | 8/1964 | Japan . |
| 0162975 | 9/1983 | Japan . |
| 1069283 | 5/1967 | United Kingdom . |

OTHER PUBLICATIONS

RCA-Technical Notes No. 375, Jun. 1960.

R. M. Schaffet, "A New High-Sensitivity Organic Photoconductor for Electrophotography" IBM Journal of Res. & Dev. Vol. 15 No. 1, pp. 75-89, Jan. 1971.

*Primary Examiner*—John E. Kittle

*Assistant Examiner*—Mukund J. Shah

*Attorney, Agent, or Firm*—Fitzpatrick, Cella, Harper & Scinto

[57] ABSTRACT

A light receiving member provided with a coating layer having a light receiving layer on a substrate, where the thickness of the coating layer is regularly changed within the minute width of the coating layer.

37 Claims, 5 Drawing Figures

LIGHT RECEIVING MEMBER HAVING TAPERED REFLECTIVE SURFACES BETWEEN SUBSTRATE AND LIGHT RECEIVING LAYER

BACKGROUND OF THE INVENTION

1. Field of the Invention

This invention relates to a light receiving member such as electrophotographic photosensitive member, etc., and a process for forming an image on it, and more particularly to a light receiving member suitable for an electrophotographic printer of a type of line-scanning a laser beam on an image pattern and a process for forming an image on it.

2. Description of the Prior Art

Electrophotographic printers of a type of line-scanning a laser beam have heretofore utilized gas lasers of relatively short wavelength such as helium-cadmium laser, argon laser, helium-neon laser, etc. as laser beam. A CdS-binder-based photosensitive layer having a thick photosensitive layer, and a charge transfer complex [IBM Journal of the Research and Development, January (1971), pages 75–89] have been also utilized as an electrophotographic photosensitive member. Thus, the laser beam undergoes no multiple reflection in the photosensitive layer with the result that no image of interference fringe pattern actually appears during the image formation.

In the meantime, a semi-conductor laser has been recently utilized in place of the gas laser to produce the devices on a smaller scale and at a lower cost. The semi-conductor laser generally has an oscillation wavelength in a longer wavelength region such as 750 nm or more, and thus an electrophotographic photosensitive member having a high sensitivity characteristic in the longer wavelength region have been needed, and consequently research and development of electrophotographic photosensitive members having such sensitivity characteristic have been so far made.

So far known photosensitive members having a photosensitivity to light of longer wavelength, for example. 600 nm or more, include, for example, a lamination type electrophotographic photosensitive member having a layer structure comprising a charge transport layer and a charge generation layer containing phthalocyanine pigments such as copper phthalocyanine, aluminum chloride phthalocyanine, etc., and also an electrophotographic photosensitive member using a selenium-tellurium film.

When such a photosensitive member having a photosensitivity to light of longer wavelength is subjected to laser beam exposure on an electrophotographic printer of laser beam scanning type, an interference fringe pattern appears on the formed toner image and no good reproduction image can be obtained. One of causes for these disadvantageous phenomena seems to be that the longer wavelength laser is not completely absorbed in the photosensitive layer and the transmitted light undergoes normal reflection on the substrate surface, generating multiple reflections of the laser beam in the photosensitive layer, and causing an interference between the reflected light on the photosensitive layer surface and the multiple reflections.

To eliminate multiple reflections generated in the photosensitive layer to overcome the disadvantages, a method for roughening the surface of electroconductive substrate used in the electrophotographic photosensitive member by anodic oxidation or by sand blasting, a method for providing a light-absorbing layer or a reflection-preventing layer between the photosensitive layer and the substrate, etc. have been so far proposed, but actually the interference fringe pattern appearing during the image formation cannot be completely eliminated. Particularly according to the method for roughening the surface of electroconductive substrate it is hard to form a roughened surface with uniform roughness, and sites with relatively large roughness may be sometimes formed to some degree. These sites with relatively large roughness may act as carrier injection ports into the photosensitive layer, generating white dots during the image formation or black dots when the reversal development system is used. Thus, the surface-roughening method is not preferable. Furthermore, it is difficult to produce electroconductive substrates with uniform roughness in one lot during the production and thus the method still has many improvements. Even according to the method using a light-absorbing layer or a reflection-preventing layer, the interference fringe pattern cannot be thoroughly eliminated, and furthermore there are disadvantages of increased production cost, etc.

SUMMARY OF THE INVENTION

An object of the present invention is to provide a novel light receiving member, for example, an electrophotographic photosensitive member, without said disadvantages and a process for forming an image on it.

Another object of the present invention is to provide an electrophotographic photosensitive member for ready production of electroconductive substrates with uniform surface characteristics in one lot.

Further object of the present invention is to provide an electrophotographic photosensitive member with complete elimination of an interference fringe pattern appearing during the image formation and black dots appearing during the reversal development at the same time and a process for forming an image on it.

These objects of the present invention can be attained by a light receiving member provided with a coating layer having a light receiving layer (which will be hereinafter referred to merely as "photosensitive layer") on a substrate, characterized in that the thickness of the coating layer is regularly changed within a minute width, and preferably that tapered reflective surfaces having a taper height of at least $\lambda/2$, where $\lambda$ is a wavelength of incident light during an image exposure, preferably 0.1 $\mu$m–100 $\mu$m, more preferably 0.3 $\mu$m–30 $\mu$m, are formed along the direction of the minute width of preferably not more than 1000 $\mu$m, and more preferably 10 $\mu$m–500 $\mu$m, between the substrate and the photosensitive layer.

DETAILED DESCRIPTION OF THE PREFERRED EMBODIMENTS

Figure 1:
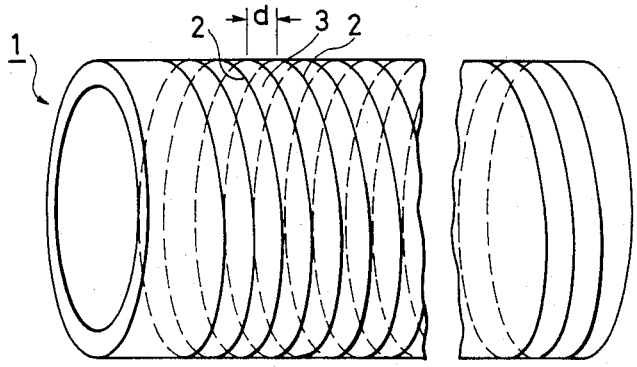
FIG. 1 is a perspective view of an electroconductive substrate used in the present invention.

FIG. 1 shows an example of an electroconductive substrate used in the present invention. The present invention is not limited to the cylindrical shape shown in FIG. 1, but a sheet form or plate form can be also utilized.

Electroconductive substrate 1 shown in FIG. 1 has linear projections 2 and tapered reflective surfaces 3 corresponding to cutting line, as formed regularly at intervals of minute width d. The linear projections 2 and tapered reflective surfaces 3 can be formed spirally when the electroconductive substrate 1 is in a cylindrical form, and can be also formed, for example, perpendicularly or in parallel to the longitudinal direction of the cylindrical substrate or in a wave form to the longitudinal direction or lateral direction of the substrate, or the linear projections 2 and the tapered reflective surfaces 3 can be formed perpendicularly and in parallel to the longitudinal direction at the same time.

Figure 2:
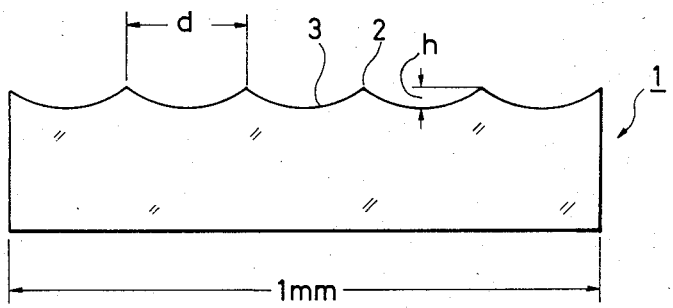
FIG. 2 is an enlarged cross-sectional view of the electroconductive substrate.

FIG. 2 shows an enlarged cross-sectional view of electroconductive substrate 1 shown in FIG. 1, where 5 linear projections 2 and 5 tapered reflective surfaces 3 are formed per 1 mm width. Needless to say, the present invention is not limited to this embodiment, but the minute width d can be set to 1000 μm (having one linear projection 2 per 1 mm width) or less, preferably to 10 μm (having 100 linear projections 2 per 1 mm width)—500 μm (having 2 linear projections 2 per 1 mm width).

Tapered reflective surfaces 3 shown in FIG. 2 are surfaces corresponding to cutting lines, formed by regular cutting by a cutting knife, etc. and their cross-sectional shape may be semi-circular as shown in FIG. 2, or may be U-shape, V-shape, sawteeth shape, trapezoidal or semi-ellipsoidal.

Tapered reflective surfaces 3 have a taper height h. It is preferable that the taper height h is at least $\lambda/2$, where $\lambda$ is a wavelength of incident light during an image exposure, to effectively eliminate an interference fringe pattern appearing during the image formation. More specifically, the taper height h is set preferably to 100 μm or less, and more preferably to 0.3 μm–30 μm. When the taper height h is more than 100 μm, a barrier layer to be provided on the tapered reflective surfaces cannot cover most of the linear projections 2, and even if an electroconductive layer containing titanium oxide particles as rendered electroconductive and dispersed in a resin is provided on the surfaces, the surface of the electroconductive layer still has projections corresponding to the linear projections 2 on the electroconductive substrate 1, and the former projections cannot be thoroughly covered by the barrier layer. Thus, carrier injection into the photosensitive layer from the projections occurs even in this case, and the carrier-injected sites appear as white dots during the image formation, or as black dots when the reversal development is used. That is, this is not preferable for the image formation.

The tapered reflective surfaces 3 can be formed by machine cutting, for example, by fixing a single point tool having a semi-circular edge, semi-ellipsoidal edge, U-shaped edge, V-shaped edge or trapezoidal edge to a milling machine or a lathe, and regularly moving an electroconductive substrate against the fixed single point tool.

According to a preferable embodiment of the present invention, tapered reflective surfaces 3 in the shape as shown in FIG. 2 can be formed by cutting by means of a single point tool having a semi-circular edge with a radius of 0.1 mm–50 mm at a pitch of 1000 μm or less, where the productivity can be enhanced by use of a multiple single point tool comprising a plurality of single point tools as connected to one another in parallel.

After the machine cutting as described above, anodic oxidation or surface treatment of dipping in a solution of sodium silicate, potassium fluorozirconate, or the like can be also applied to the resulting electroconductive substrate, or furthermore a method disclosed in Japanese Patent Publication No. 47-5125, that is, anodic oxidation followed by dipping in an aqueous solution of alkali metal silicate can be also applied thereto.

The above-mentioned anodic oxidation can be carried out by passing an electric current through the electroconductive substrate as an anode in an aqueous or non-aqueous solution of inorganic acid such as phosphoric acid, chromic acid, sulfuric acid, boric acid, etc. or organic acid such as oxalic acid, sulfamic acid, etc.

The electroconductive substrate 1 used in the present invention can be made of a metal or alloy of aluminum, brass, copper, stainless steel, etc., or a plastic film of polyester, etc. having a vapor deposition film of aluminum, tin oxide, or indium oxide thereon.

Figure 3A:
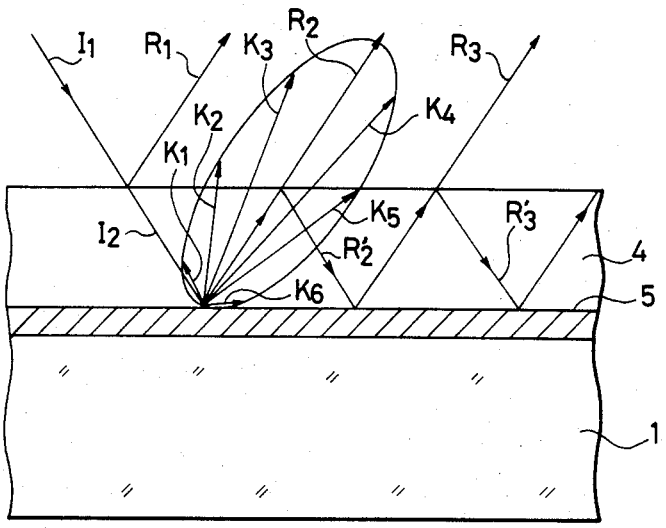
FIG. 3(A) is a cross-sectional view according to one embodiment of the conventional electrophotographic photosensitive member.
Figure 3B:
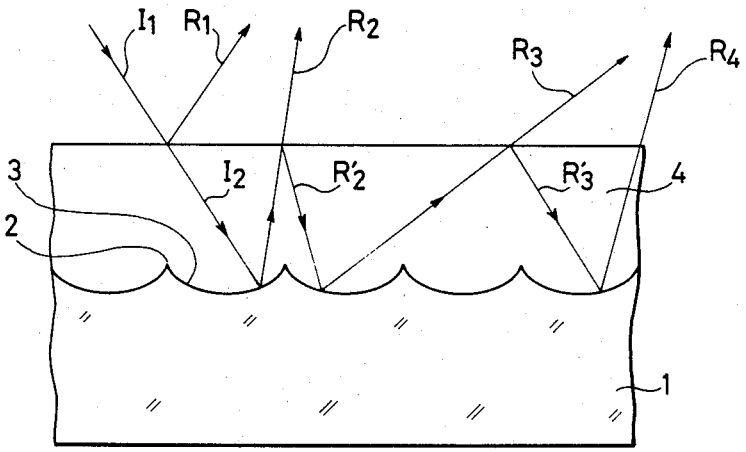
FIG. 3(B) is a cross-sectional view according to one embodiment of the present electrophotographic photosensitive member.

FIG. 3 schematically shows modes of electrophotographic photosensitive members exposed to a laser beam as a coherent light, where FIG. 3(A) shows a mode of the conventional electrophotographic photosensitive member and FIG. 3(B) a mode of the present electrophotographic photosensitive member.

When photosensitive layer 4 of the electrophotographic photosensitive member in FIG. 3(A) is exposed to a laser beam $I_1$, a reflected ray $R_1$ is generated from some of the laser beam $I_1$ on the surface of photosensitive layer 4, while the remaining portion of the laser beam $I_1$ is transmitted through the photosensitive layer 4 and reaches a light-diffusion surface 5 of the electroconductive substrate 1 as laser beam $I_2$. Some of the laser beam $I_2$ generates diffused rays $K_1$, $K_2$, . . . on the light-diffusion surface 5, while the remaining portion of laser beam $I_2$ generates a strong normal reflected ray $R_2$. Some of normal reflected ray $R_2$ is further normally reflected at the interface between the photosensitive layer 4 and the air layer to generate a reflected ray $R'_2$. The reflected ray $R'_2$ is again transmitted through the photosensitive layer 4. Some of reflected ray $R'_2$ generates a normal reflected ray $R_3$ on the light-diffusion surface 5, while being subjected to the light-diffusion effect thereon, though not in the drawing. That is, when the photosensitive layer 4 is exposed to the incident beam $I_1$, multiple reflections occur successively in the photosensitive layer 4 in this manner, even if the electroconductive substrate 1 has the light-diffusion surface 5, and thus phase differences occur in the respective wavelength among the reflected rays $R_1$, $R_2$, $R_3$, . . . to cause an interference.

According to the mode shown in FIG. 3(B) which embodies the present invention, on the other hand, tapered reflective surfaces 3 are formed on the electroconductive substrate 1 in the present electrophotographic photosensitive member, and a photosensitive layer 4 is provided on the tapered reflective surfaces. Some of incident beam $I_1$ irradiated onto the photosensitive layer 4 is reflected on the surface of photosensitive layer 4 to generate a reflected ray $R_1$, while the remaining portion of the incident beam $I_1$ is transmitted through the photosensitive layer 4 as transmitted beam $I_2$ and is normally reflected on one of the tapered reflective surfaces 3 to generate a reflected ray $R_2$. Some of reflected ray $R_2$ is normally reflected at the interface between the photosensitive layer 4 and the air layer to generate a reflected ray $R'_2$, which is again normally reflected at one of the tapered reflective surfaces 3. That is, multiple reflections of incident beam $I_1$ occur successively in the photosensitive layer 4 in this manner, and it is expected that an interference is caused among reflected rays $R_1$, $R_2$, $R_3$, . . .

However, the present inventors have surprisingly found that, when an image exposure by laser beam and a toner development are successively carried out to form an image after a photosensitive layer 4 provided on an electroconductive substrate 1 having the tapered reflective surfaces 3 has been electrically charged, no interference fringe pattern is formed at all in the image. The reason seems that the interference fringe pattern generated by rays reflected on the tapered reflective surfaces 4 is too fine to be visible to the eyes and toner particles generally have relatively large particle sizes such as about 15–30 μm, as compared with the interference fringe pattern, and thus no fine interference infringe pattern appears in the toner image, though this is still a mere assumption. Theoretical analysis of elimination of an interference fringe pattern by the tapered reflective surfaces 3 will need further study and investigation as a future task. Anyway, it is a surprising fact that an interference fringe pattern, which has appeared so far in the toner image, can be completely eliminated by providing tapered reflective surfaces 3 between the photosensitive layer 4 and the electroconductive substrate 1, and the present invention has been established on the finding this surprising phenomenon.

Figure 4:
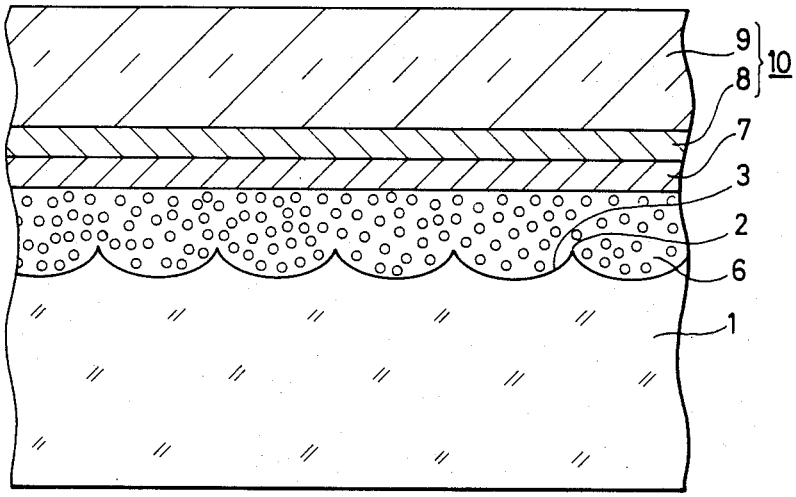
FIG. 4 is a cross-sectional view according to another embodiment of the present invention.

FIG. 4 shows a preferable embodiment of the present invention, where an electrophotographic photosensitive member comprises an electroconductive substrate 1 having linear projections 2 and tapered reflective surfaces 3, an electroconductive layer 6, a barrier layer 7, and a photosensitive layer 10 in a laminated structure of a charge generation layer 8 and a charge transport layer 9, the layers being placed one upon another by coating.

The electroconductive layer 6 can be made, for example, of a vapor-deposition film of electroconductive metal such as aluminum, tin or gold, or of a film containing electroconductive powders as dispersed in resin. The electroconductive powders for this purpose can be metallic powders of aluminum, tin, silver, etc., carbon powders, or electroconductive pigments containing metal oxides such as titanium oxide, barium sulfate, zinc oxide, tin oxide, etc. as the main component. The electroconductive layer can also contain a light-absorbing agent.

Any resin can be used for dispersing the electroconductive powders, so long as it can satisfy the following conditions: (1) strong adhesiveness to the substrate, (2) good powder dispersibility, (3) good solvent resistance, etc. Particularly, thermosetting resins such as curable rubber, polyurethane resin, epoxy resin, alkyd resin, polyester resin, silicone resin, acryl-melamine resin, etc. are preferable. The volume resistivity of the resin containing the electroconductive powders as dispersed therein is $10^{13}$ Ωcm or less, preferably $10^{12}$ Ωcm or less. To this end, it is preferable that the resin film contains 10–60% by weight of the electroconductive powders.

The electroconductive layer 6 can contain a surface energy-lowering agent such as silicone oil, various surfactants, etc. to obtain a uniform coating surface with less coating defects. The electroconductive powders can be dispersed into the resin by the ordinary means, for example, by a roll mill, ball mill, vibration mill, attriter, sand mill, colloid mill, etc. When the substrate is in a sheet form, wire bar coating, blade coating, knife coating, roll coating, screen coating, etc. are preferable. When the substrate is in a cylindrical form, dipping coating is preferable.

When the height h of projections 2 on the electroconductive substrate 1 is 100 μm or less, the surface defects of the electroconductive layer 6 can be thoroughly covered when the electroconductive layer 6 having a thickness of generally about 1 μm–50 μm, preferably about 5 μm–30 μm is provided on the electroconductive substrate 1 by coating.

The barrier layer 7 having a barrier function and an adhesive function is provided between the electroconductive layer 6 and the photosensitive layer 10, and can be made of casein, polyvinyl alcohol, nitrocellulose, ethylene-acrylic acid copolymers, polyamides (nylon 6, nylon 66, nylon 610, nylon copolymer, alkoxymethylated nylon, etc.), polyurethanes, gelatin, etc. The thickness of the barrier layer 7 is 0.1 μm–5 μm, preferably 0.5 μm–3 μm.

The charge generation layer 8 used in the present invention can be formed from a dispersion of an organic charge-generating material selected from azo pigments such as Sudan Red, Dian Blue, Janus Green B, etc.; Quinone pigments such as Algol Yellow, Pyrene Quinone, Indanthrene Brilliant Violet RRP; quinocyanine pigments; perylene pigments; indigo pigments such as indigo, thioindigo, etc; bisbenzimidazole pigments such as Indofast Orange toner, etc.; phthalocyanin pigments such as copper phthalocyanin, aluminochlorophthalocyanin, etc.; quinacridone pigments; and azulenium salt compounds in a binder resin such as polyester, polystyrene, polyvinylbutylal, polyvinylpyrrolidone, methylcellulose, polyacrylic acid esters, cellulose ester, etc. The thickness of the charge generation layer 8 is about 0.01 μm–1 μm, preferably about 0.05 μm–0.5 μm.

The charge transport layer 9 can be formed from a solution of a positive hole-transferable material selected from compounds having a polycyclic aromatic ring such as anthracene, pyrene, phenanthrene, coronene, etc. or a nitrogen-containing hetero ring such as indole, carbazole, oxazole, isoxazole, thiazole, imidazole, pyrazole, oxadiazole, pyrazoline, thiadiazole, triazole, etc. at the main chain or at the side chain in a film-formable resin. Generally, the charge-transferable material has a low molecular weight and has a poor film formability by itself. The film-formable resin is exemplified by polycarbonate, polymethacrylic acid esters, polyarylate, polystyrene, polyesters, polysulfone styrene-acrylonitrile copolymer, styrene-methyl methacrylate copolymer, etc.

The charge transport layer 9 has a thickness of 5 μm–20 μm. The photosensitive layer 10 can be in a lamination structure in which the charge generation layer 8 is placed on the charge transport layer 9. The photosensitive layer 10 is not limited to the said structure, but, for example, a charge transfer complex made of polyvinylcarbazole and trinitrofluorenone disclosed in the said IBM Journal of the Research and Development, January (1971), pages 75–89, photosensitive layers using a pyrylium-based compound disclosed in U.S. Pat. No. 4,315,983, U.S. Pat. No. 4,327,169, etc., photosensitive layers containing a well known inorganic photoconductive material such as zinc oxide or cadmium sulfide as sensitized with a pigment and dispersed in resin, or a vapor-deposition film of selenium, selenium-tellurium, etc. can be also utilized in the present invention.

The present electrophotographic photosensitive member can be used in an electrophotographic type printer using not only a semi-conductor laser of relatively long wavelength (for example, 750 nm or more), but also other laser beams, for example, helium-neon laser, helium-cadmium laser, argon laser, etc. The present invention can completely eliminate an interference fringe pattern appearing in the toner image according to the conventional process when a coherent light such as said laser beams is used as a light source, and the present invention also can effectively eliminate black dots.

That is, the electrophotographic printer using a laser beam generally utilizes a reversal development system which comprises electrically charging an electrophotographic photosensitive member, then exposing the member to a laser beam by positive image scanning corresponding to image signals (so-called image scanning exposure), thereby forming an electrostatic latent image, and then applying to the electrostatic latent image a developing agent containing a toner having the same polarity as that of the electrostatic latent image, thereby depositing the toner on the image-scanned, positive image-exposed parts, where undesirable toner deposition appears in black dots in the formed toner image, because the sand blast-roughened surface has a large fluctuation in the distribution of projection heights, which include, for example, projections of very small height and those of very large height, and no uniformly roughened surface is obtained, as described before. Thus, the carrier injection into the charge generation layer from the projections of unnecessarily large height is inevitable and the carrier injection from such projections can be electrostatically neutralized with the electric charge applied thereto during the electric charging. That is, the image-exposed state is electrically brought about and toner deposition is caused to take place during the toner development, resulting in formation of black dots.

In the present electrophotographic member, on the other hand, the tapered reflective surfaces having a uniform height are formed regularly in parallel along the direction of the minute width on the surface of an electroconductive substrate by machine cutting by means of a single point tool fixed to a milling machine or a lathe, as described before, and thus there are no carrier injection sites and no black dots appear at all even when the development is carried out by the reversal development system, as will be described in detail below. Needless to say, the present invention is not limited to said reversal development system, but various development processes, for example, cascade development, magnetic brush development, powder cloud development, jumping development, and liquid development can be utilized.

The present invention will be described below, referring to Examples.

EXAMPLE 1

A cutting tool was fixed to a lathe so that the cutting tool can push an aluminum cylinder, 60 mm in diameter and 258 mm long, at one end to cut the aluminum cylinder to the depth of 1.8 μm from the surface, and was moved along the aluminum cylinder to the other end at a moving speed of 200 μm per revolution of the aluminum cylinder while rotating the aluminum cylinder to effect machine cutting, whereby tapered reflective surfaces having the cross-sectional shape as shown in FIG. 2 were formed at pitches of 200 μm.

The surface of the thus machine cut aluminum cylinder was investigated by a universal surface shape tester (SE-3C made by Osaka Kenkyusho, Japan), and it was found that the tapered reflective surfaces with a height of 1.8 μm and a width of 200 μm were regularly formed at pitches of 200 μm.

Then, 25 parts by weight of titanium oxide (ECT-62, made by Titan Kogyo K.K. Japan), 25 parts by weight of titanium oxide (SR-IT, made by Sakai Kogyo K.K., Japan) and phenol resin (Plyophen J325, made by Dainihon Ink Kogyo K.K., Japan) were mixed with 500 parts by weight of methanol and methylcellosolve in a ratio of methanol:methylcellosolve=4:15 by weight with stirring, and the mixture was dispersed in a sand mill disperser together with 50 parts by weight of glass beads of diameter 1 mm for 10 hours. The resulting dispersion was admixed with 50 ppm of silicone oil (SH289A, made by Toshiba Silicone K.K., Japan) in terms of solid matters with stirring, whereby a coating solution for forming an electroconductive layer was prepared.

The thus prepared coating solution was applied to the surface of the said machine cut aluminum cylinder by dipping to obtain a film thickness of 20 μm after drying, and then the coating was dried by heating at 140° C. for 30 minutes, whereby an electroconductive layer was formed.

Then, 10 parts by weight of nylon copolymer resin (CM-8000, made by Toray K.K., Japan) was dissolved in a mixture of 60 parts by weight of methanol and 40 parts by weight of butanol, and the resulting solution was applied onto the electroconductive layer by dipping to provide a polyamide resin layer having the thickness of 1 μm.

Then, 1 part by weight of ε-type copper phthalocyanin (Linol Blue ES, made by Toyo Ink K.K., Japan), 1 part by weight of butyral resin (Eslec BM-2, made by Sekisui Kagaku K.K., Japan), and 10 parts by weight of cyclohexanone were dispersed in a sand mill disperser containing glass beads, 1 mm in diameter, for 20 hours, and then the resulting dispersion was diluted with 20 parts by weight of methylethylketone. The resulting dispersion was applied onto the previously formed polyamide resin layer by dipping and dried to provide a charge generation layer having a thickness of 0.3 μm.

Then, 10 parts by weight of a hydrazone compound having the following structural formula:

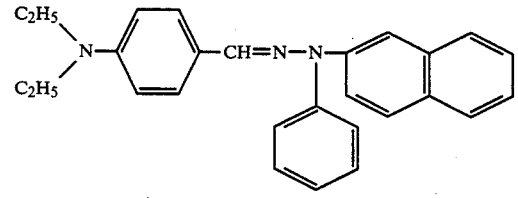

and 15 parts by weight of styrene-methyl methacrylate copolymer resin (MS200, made by Seitetsu Kagaku K.K., Japan) were dissolved in 80 parts by weight of toluene. The resulting solution was applied onto the charge generation layer and dried in hot air at 100° C. for one hour to provide a charge transport layer having a thickness of 16 μm.

The thus prepared electrophotographic photosensitive member (photosensitive drum) was mounted on Canon laser beam printer (LBP-CX, made by Canon, Kabushiki Kaisha, Japan), a reversal development type, electrophotographic printer using a semi-conductor Laser having the oscillation wavelength of 778 nm, and subjected to line scanning on the whole surface to form a whole surface image of black toner. No interference fringe pattern appeared at all on the whole surface black image.

Then, the member was subjected to 2,000 repetitions of an operation of line scanning with the laser beam according to a letter signal at the temperature of 15° C. and the relative humidity of 10% to form the letter image, and the 2000th copy of letter image was investigated by counting the number of black dots having a diameter of 0.2 mm or more on the copy of letter image. No black dots were found at all.

COMPARATIVE EXAMPLE 1

An electrophotographic photosensitive member was prepared in the same manner as in Example 1 except that the surface of the aluminum cylinder was roughened by the sand blasting in place of the machine cutting used in preparing the electrophotographic photosensitive device of Example 1. The surface state of the roughened aluminum cylinder by the sand blasting was investigated by a universal surface shape tester (SE-3C, made by Osaka Kenkyusho, Japan) before providing the electroconductive layer thereon, and it was found that the average surface roughness was 1.8 μm.

The electrophotographic photosensitive member thus prepared for comparison was mounted on the same laser beam printer as used in Example 1 and subjected to the same investigation as in Example 1. It was found that distinct interference fringes were formed on the whole surface black image. On the 2,000th copy of letter image, about 30 black dots having a diameter of 0.2 mm or more per 10 $cm^2$ were formed. Thus, the image was very poor.

EXAMPLE 2

10 g of fine zinc oxide particles (Sazex 2000, made by Sakai Kagaku K.K., Japan), 4 g of acrylic resin (Dianal LR009, made by Mitsubishi Rayon K.K. Japan), 10 g of toluene, and 10 mg of an azulenium salt compound having the following structural formula:

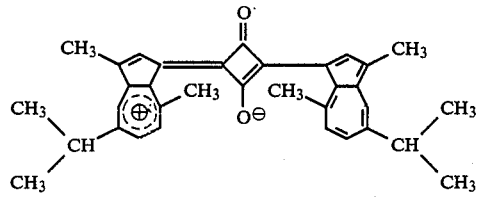

were thoroughly mixed in a ball mill to prepare a coating solution for forming a photosensitive layer. An electrophotographic photosensitive member was prepared in the same manner as in Example 1, except that the resulting coating solution was used to form a photosensitive layer having a thickness of 21 μm after drying in place of the photosensitive layer of lamination type comprising the charge generation layer and the charge transport layer used in Example 1.

The thus prepared electrophotographic photosensitive member was mounted on the same laser beam printer as used in Example 1 except that the electric charger was changed to make the charge positive and the toner was changed to a positive toner, and subjected to the same investigation. It was found that no interference fringe pattern was observed on the whole surface black image and no black dots having a diameter of 0.2 mm or more were observed on the 2,000th copy of letter image, and thus a very good image was obtained.

EXAMPLE 3

The same aluminum cylinder as machine cut in Example 1 was subjected to anodic oxidation according to the conventional method to form a film of aluminum oxide, and a film of selenium-tellurium was formed thereon to a thickness of 15 μm by vacuum vapor deposition.

The thus prepared electrophotographic photosensitive member was mounted on the same laser beam printer as used in Example 2 and subjected to the same investigation as in Example 2. The same results as in Example 2 were obtained.

EXAMPLE 4

A cutting tool was fixed to a lathe so that the cutting tool can push an aluminum cylinder, 60 mm in diameter and 258 mm long, at one end to cut the aluminum cylinder to the depth of 1.8 μm from the surface, and moved along the aluminum cylinder to the other end at a moving speed of 20 μm per revolution of the aluminum cylinder to effect machine cutting.

The surface of the thus machine cut aluminum cylinder was investigated by a universal surface shape tester (SE-3C, made by Osaka Kenkyusho, Japan) and it was found that tapered reflective surfaces with a height of 0.8 μm and a width of 20 μm were regularly formed at pitches of 20 μm.

The same electroconductive layer, polyamide resin layer, charge generation layer and charge transport layer as used in Example 1 were successively formed on the aluminum cylinder by coating to prepare an electrophotographic photosensitive member. The member was mounted on the same laser beam printer as used in Example 1 and images were formed in the same manner as in Example 1. As a result, it was found that no interference fringe pattern was observed at all on the whole surface black image and no black dots were observed at all on the 2,000th copy of letter image.

COMPARATIVE EXAMPLE 2

Surface roughening by the sand blasting was used in place of the machine cutting to prepare an electrophotographic photosensitive member of Example 4, and the sand blasting was set so as to obtain an average surface roughness of 0.8 μm, as measured by a universal surface shape detector (SE-3C, made by Osaka Kenkyusho, Japan).

The same electroconductive layer, polyamide resin layer, charge generation layer and charge transport layer as in Example 1 were formed successively on the surface-roughened aluminum cylinder by coating to prepare an electrophotographic photosensitive member, and images were formed in the same manner as in Example 1. As a result, it was found that a distinct interference fringe pattern was observed on the whole surface black image and about 20 black dots having a diameter of 0.2 mm or more per 10 $cm^2$ of image were observed on the 2,000th copy of letter image.

EXAMPLE 5

An aluminum cylinder, 60 mm in diameter and 258 mm long, was mounted on a lathe and rotated so that three cutting lines can be spirally formed per mm in the longitudinal direction and to the depth of 3 μm by a cutting tool to effect machine cutting.

Then, the aluminum cylinder was mounted on a milling machine to form two cutting lines per mm in the peripheral direction to the depth of 3 μm in parallel to the longitudinal direction of the aluminum cylinder.

Tapered reflective surfaces with a height of 5 μm and a width of 1000/3 μm were regularly formed in the longitudinal direction at pitches of 1000/3 μm on the aluminum cylinder, and also tapered reflective surfaces with a height of 5 μm and a width of 500 μm were regularly formed in the peripheral direction at pitches of 500 μm.

Then, 100 parts by weight of electroconductive carbon paint (Dotite, made by Fujikura Kasei K.K., Japan) and 50 parts by weight of melamine resin (Super-Beckamin, made by Dainihon Ink K.K., Japan) were mixed with 100 parts by weight of toluene. The resulting mixture was applied to the previously machine cut aluminum cylinder by dipping, and then thermoset at 150° C. for 30 minutes to form an electroconductive layer having a thickness of 4 μm.

Then, the same polyamide resin layer, charge generation layer and charge transport layer as used in Example 1 were successively formed on the electroconductive layer to prepare an electrophotographic photosensitive member.

The thus prepared member was mounted on the same laser beam printer as used in Example 1 to form images in the same manner as in Example 1. It was found that no interference fringe pattern was observed at all on the whole surface black image and no black dots were observed at all on the 2,000th copy of letter image.

COMPARATIVE EXAMPLE 3

An electrophotographic photosensitive member was prepared for comparison in the same manner as in Example 1, except that a sand blast-roughened aluminum cylinder having an average surface roughness of 3 μm was used in place of the machine cut aluminum cylinder of Example 5, and subjected to image formation. As a result, it was found that a slight weaker interference fringe pattern than that of comparative Example 1 was observed on the whole surface black image, and more than 40 black dots having a diameter of 0.2 mm or more were formed per 10 $cm^2$ on the 2,000th copy of letter image.

What is claimed is:

1. A light receiving member for image formation with incident light of wavelength λ provided with a coating layer containing a light receiving layer on a metallic cylindrical substrate, which comprises the coating layer having a regularly changed thickness within the minute width of the coating layer, said substrate having tapered reflective surfaces of a height of at least λ/2 formed vertically to the longitudinal direction of the metallic cylinder and said regularly changed thickness being formed by said tapered reflective surfaces.

2. A light receiving member according to claim 1, wherein the tapered reflective surfaces are regularly formed at minute distances.

3. A light receiving member according to claim 1, wherein the minute width is not more than 1,000 μm.

4. A light receiving member according to claim 1, wherein the minute width is 10 μm–500 μm.

5. A light receiving member according to claim 1, wherein the tapered reflective surfaces have a height of not more than 100 μm.

6. A light receiving member according to claim 1, wherein the tapered reflective surfaces have a height of 0.3 μm–30 μm.

7. A light receiving member according to claim 1, wherein the light receiving layer is a photosensitive layer of lamination type containing a charge generation layer and a charge transport layer.

8. A light receiving member according to claim 7, wherein the charge generation layer has a thickness of 0.01 μm–1 μm.

9. A light receiving member according to claim 7, wherein the charge generation layer has a thickness of 0.05 μm–0.5 μm.

10. A light receiving member according to claim 7, wherein the charge generation layer contains an organic charge-generating material and a binder resin.

11. A light receiving member according to claim 10, wherein the organic charge-generating material is at least one member selected from the group consisting of azo pigments, quinone pigments, quinocyanin pigments, perylene pigments, bisbenzimidazole pigments, phthalocyanin pigments, quinacridone pigments, and azulenium salt compounds.

12. A light receiving member according to claim 1, wherein the light receiving layer contains inorganic photoconductive particles sensitized with a pigment and a binder resin.

13. A light receiving member according to claim 1, wherein the light receiving layer contains a charge transfer complex.

14. A light receiving member according to claim 1, wherein the light receiving layer contains a pyrylium type compound.

15. A light receiving member for image formation with incident light of wavelength λ provided with a coating layer containing a light receiving layer on a substrate, said substrate having tapered reflecting surfaces, which comprises the coating layer having a regularly changed thickness within the minute width of the coating layer, wherein an electro-conductive layer is provided between the substrate having the tapered reflective surfaces and the light receiving layer and said tapered reflective surfaces have a height of at least λ/2.

16. A light receiving member according to claim 15, wherein the electroconductive layer contains electroconductive powders and a binder resin and has a thickness of 1 μm–50 μm and a volume resistivity of not more than $10^{13}$ Ωcm.

17. A light receiving member according to claim 16, wherein the electroconductive powders are metal powders or metal oxide powders.

18. A light receiving member according to claim 16, wherein the electroconductive layer contains electroconductive powders and a light-absorbing agent.

19. A light receiving member according to claim 15, wherein an electroconductive layer and a barrier layer are provided between the substrate having the tapered reflective surfaces and the light-receiving layer.

20. A light receiving member according to claim 15, wherein the substrate having the tapered reflective surfaces is a substrate with an anodically oxidized surface.

21. A light receiving member according to claim 15, wherein the tapered reflective surfaces are surfaces formed by machine cutting by a cutting tool which regularly moves along the surface of the electroconductive substrate.

22. A process for forming an image with coherent light of wavelength λ, which comprises a first step of applying an electric charge to a light receiving member having a coating layer containing a light receiving layer on a metallic cylindrical substrate, the coating layer having a regularly changed thickness within the minute width of the coating layer, said substrate having tapered reflective surfaces of a height of at least λ/2, formed vertically to the longitudinal direction of the metallic cylinder and said regularly changed thickness being formed by said tapered reflective surfaces, a second step of irradiating with the coherent light, and a third step of developing with a developing agent containing a toner.

23. A process according to claim 22, wherein the coherent light is a laser beam.

24. A process according to claim 23, wherein the third step is a step of developing with a developing agent containing a toner having the same polarity as that of the electric charge applied in the first step.

25. A process according to claim 23, wherein the laser beam is a laser beam generated by a semiconductor laser device.

26. A process according to claim 23, wherein the light receiving layer is irradiated with the coherent light by positive image scanning exposure corresponding to an image signal or letter signal.

27. A process according to claim 23, wherein the substrate having the tapered reflective surfaces along the direction of the minute width is covered with the light receiving layer.

28. An electrophotographic device provided with a photosensitive drum having a metallic cylinder or alloy substrate and a photosensitive layer having a regularly changed thickness within the minute width of the photosensitive layer, and a laser beam generator to generate light of a wavelength λ, which comprises the metallic cylinder or alloy substrate having tapered reflective surfaces of a height of at least λ/2 formed vertically to the longitudinal direction of the metallic cylinder and said regularly changed thickness being formed by said tapered reflective surfaces.

29. An electrophotographic device according to claim 28, wherein the metallic cylinder or alloy substrate is an aluminum cylinder.

30. An electrophotographic device according to claim 28, wherein the laser beam generator is a semiconductor laser beam generator.

31. An electrophotographic device according to claim 28, wherein an electroconductive layer is provided between the metallic cylinder or alloy substrate and the photosensitive layer.

32. An electrophotographic device according to claim 28, wherein an electroconductive layer is provided between the metallic cylinder or alloy substrate and the photosensitive layer, and a barrier layer is provided on the electroconductive layer.

33. An electrophotographic device according to claim 28, wherein the photosensitive layer is a photosensitive layer of lamination type containing a charge generation layer and a charge transport layer.

34. An electrophotographic device according to claim 28, wherein the minute width is not more than 1,000 μm.

35. An electrophotographic device according to claim 28, wherein the minute width is 10 μm–500 μm.

36. An electrophotographic device according to claim 28, wherein the tapered reflective surfaces have a height of not more than 100 μm.

37. An electrophotographic device according to claim 28, wherein the tapered reflective surfaces have a height of 0.3 μm–30 μm.

* * * * *